US011846406B1

(12) United States Patent
Jiang

(10) Patent No.: US 11,846,406 B1
(45) Date of Patent: Dec. 19, 2023

(54) SMALL-SIZED APERTURE ASSEMBLY AND STAGE LIGHT FIXTURE HAVING SAME

(71) Applicant: Guangzhou Haoyang Electronic Co., Ltd., Guangzhou (CN)

(72) Inventor: Weikai Jiang, Guangzhou (CN)

(73) Assignee: GUANGZHOU HAOYANG ELECTRONIC CO., LTD., Guangdong (CN)

( * ) Notice: Subject to any disclaimer, the term of this patent is extended or adjusted under 35 U.S.C. 154(b) by 0 days.

(21) Appl. No.: 17/977,552

(22) Filed: Oct. 31, 2022

Related U.S. Application Data

(63) Continuation of application No. PCT/CN2022/124059, filed on Oct. 9, 2022.

(30) Foreign Application Priority Data

Sep. 30, 2022 (CN) ..... 202222610105.1

(51) Int. Cl.
*F21V 11/10* (2006.01)
*F21W 131/406* (2006.01)
*F21S 10/00* (2006.01)

(52) U.S. Cl.
CPC ..... *F21V 11/10* (2013.01); *F21S 10/007* (2013.01); *F21W 2131/406* (2013.01)

(58) Field of Classification Search
CPC ..... F21V 11/10; F21W 2131/406
See application file for complete search history.

(56) References Cited

U.S. PATENT DOCUMENTS

2006/0033974 A1* 2/2006 Sato ..... G03B 21/20 359/227
2006/0276072 A1* 12/2006 Fukasawa ..... H04N 9/3141 348/E9.027
2010/0021157 A1* 1/2010 Kawamoto ..... G03B 9/06 396/510
2011/0063847 A1* 3/2011 Quadri ..... F21V 11/10 362/284
2014/0111843 A1* 4/2014 Kozu ..... G03B 9/06 359/230
2014/0212123 A1* 7/2014 Sato ..... G03B 9/06 396/510
2016/0139490 A1* 5/2016 Nakano ..... G03B 9/06 396/505
2016/0139491 A1* 5/2016 Nakano ..... G03B 9/06 396/510

(Continued)

FOREIGN PATENT DOCUMENTS

EP 1455202 A1 * 9/2004 ..... G02B 21/06

*Primary Examiner* — Alexander K Garlen
(74) *Attorney, Agent, or Firm* — Muncy, Geissler, Olds & Lowe, P.C.

(57) ABSTRACT

A small-sized aperture assembly includes a base plate, an optical shutter fixed to the base plate, a motor providing a driving force, a linkage mechanism with one end connected to the motor, and a transition gear located between the linkage mechanism and the optical shutter. A periphery of the optical shutter is provided with a sawtooth segment meshed with the transition gear, and the other end of the linkage mechanism is hinged to the transition gear, so that the linkage mechanism drives the transition gear to move under the driving of the motor, and enables the optical shutter to switch between a closed state and an open state.

16 Claims, 5 Drawing Sheets

(56) References Cited

U.S. PATENT DOCUMENTS

| | | | | |
|---|---|---|---|---|
| 2016/0363289 | A1* | 12/2016 | Hansen | G02B 26/02 |
| 2018/0074387 | A1* | 3/2018 | Yoshizawa | G03B 9/06 |
| 2018/0180971 | A1* | 6/2018 | Yoshizawa | G03B 9/06 |

* cited by examiner

SMALL-SIZED APERTURE ASSEMBLY AND STAGE LIGHT FIXTURE HAVING SAME

CROSS REFERENCE TO RELATED APPLICATIONS

The present application is a continuation of International Application No. PCT/CN2022/124059, filed on Oct. 9, 2022, which claims priority from Chinese Patent Application No. 202222610105.1 filed on Sep. 30, 2022, all of which are hereby incorporated herein by reference.

TECHNICAL FIELD

The present invention relates to the technical field of stage light fixtures, and more particularly, relates to a small-sized aperture assembly and a stage light fixture having the same.

BACKGROUND

With the development of science and technology, the stage light fixtures on the market is becoming more and more functional, such as configuration of pattern components for intercepting the light beam to achieve a variety of pattern effects, configuration of a color wheel to render the light beam of the stage light fixture in different colors, configuration of blades for light shielding to achieve light dimming or effects with rapid light shielding, and adjustment of size of the aperture to project light spots in different sizes.

In the existing stage light fixture, most of the aperture assembly is fixedly connected to the light shielding device with blades and is used in cooperation with the blades to achieve light spots in different shapes. The transmission device for driving the aperture assembly is generally in form of a linkage mechanism, by directly connecting the linkage mechanism to the optical shutter with a light shade, the optical shutter can be driven to rotate by the driving mechanism through the linkage mechanism, so that the opening range of the optical shutter can be accordingly changed. However, the linkage mechanism in such way takes up large space, causing that the size of the entire aperture assembly cannot be reduced, and the linkage mechanism tends to interfere with the adjacent effect assembly during operation. In addition, the linkage mechanism is required to avoid the aperture during operation to prevent imaging with the aperture in the light path which is usually solved by setting a curve-shaped segment with a larger radian in the section of the linkage mechanism corresponding to the optical shutter. However, such configuration may cause large swing amplitude of the linkage mechanism, which in turn requires a larger working space to be reserved for the aperture assembly, thereby further increasing the whole size of the aperture assembly.

SUMMARY

The present invention thus provides a small-sized aperture assembly and a stage light fixture having the same, which can solve the problem of aperture assembly in large size, by driving the light shade with a transition gear in cooperation with a linkage mechanism.

In one aspect of the present invention, a small-sized aperture assembly is provided, which includes a base plate, an optical shutter fixed to the base plate, a motor providing a driving force, a linkage mechanism with one end connected to the motor, and a transition gear arranged between the linkage mechanism and the optical shutter. A periphery of the optical shutter is provided with a sawtooth segment which is meshed with the transition gear. The other end of the linkage mechanism is hinged to the transition gear, so that the linkage mechanism drives the transition gear to move under the driving of the motor, thereby enabling the optical shutter to switch between a closed state and an open state.

According to the present invention, with the configuration of a transition gear provided between the linkage mechanism and the optical shutter, the linkage mechanism can transmit the driving force of the motor to the transition gear, and the transition gear thus can rotate to drive the optical shutter, especially a driving ring thereof, to rotate to switch the state of the optical shutter. Therefore, with such transmission configuration, the transition gear can be driven to rotate by the linkage mechanism with shot length, resulting in less size of the aperture assembly. In addition, as the linkage mechanism is not directly connected to the optical shutter, it is not necessary to design an arc-shaped segment with a large radian to avoid the situation that the linkage mechanism overlaps with the optical shutter to affect the light effect, which effectively reduces the space occupied by the linkage mechanism, thereby further reducing the size of the aperture assembly.

According to the present invention, the linkage mechanism specifically includes a shaft arm and a swing rod pivotally connected to each other. The other end of the shaft arm is fixedly connected to the motor, and the other end of the swing rod is pivotally connected to the transition gear. Here, a rotation center of the shaft arm refers to as a first center point, a rotation center of the transition gear refers to as a second center point, a pivoting position of the shaft arm and the swing rod refers to as a first pivoting point, and a pivoting position of the swing rod and the transition gear refers to as a second pivoting point. A distance between the first center point and the first pivoting point refers to as $l_1$, a distance between the first pivoting point and the second pivoting point refers to as $l_2$, a distance between the second pivoting point and the second center point refers to as $l_3$, and a distance between the first center point and the second center point refers to as $l_4$. According to the present invention, $l_1$, $l_2$, $l_3$ and $l_4$ simultaneously conform to the following relationship: $l_1+l_2 \leq l_3+l_4$, $l_2+l_3 \geq l_1+l_4$, and $l_1$, $l_2$, $l_3$ and $l_4$ are all greater than 0. With such configuration, it is effectively ensured that under driving by the motor, the shaft arm can rotate by circles around the first center point without being restricted. Within the relationship $l_1+l_2 \leq l_3+l_4$, it is ensured that the swing rod can be driven by the shaft arm to move back and forth.

In a transmission way in which a driving gear is directly meshed with the driving ring of the optical shutter without a linkage mechanism, the open and closed states of the optical shutter are switched with the back-and-forth rotation of the driving gear. That is, in such transmission way, a motor connected to the driving gear is required to repeatedly perform operations of "forward starting-forward rotating-braking-reverse starting-reverse rotating-braking". As well known, repeated starting and braking of the motor seriously affects efficiency of the optical shutter for switching the state, making it difficult for the optical shutter to rapidly and repeatedly switch the open and closed states. However, in the present invention, in combination with the linkage mechanism and the transition gear, the size of the aperture assembly can be effectively reduced, and the motor can continuously rotate in the same direction to drive the linkage mechanism to drive the transition gear to move back and forth, that is, according to the present invention the motor can avoid repeating operations of braking and starting, the optical shutter thus can rapidly switch the open and closed states, thereby achieving the effect of rapid light shading.

According to some embodiment of the present invention, the linkage mechanism includes a shaft arm and a swing rod pivotally connected to each other. The other end of the shaft arm is fixedly connected to the motor, and the other end of the swing rod is pivotally connected to the transition gear. Especially, the swing rod is provided with an arc-shaped avoiding segment at the pivoting position with the transition gear. With configuration of the arc-shaped avoiding segment, interference of the swing rod with a pivoting member for fixing the transition gear during movement of the swing rod can be avoided.

Here, a rotation center of the transition gear refers to as a second center point, a pivoting position of the linkage mechanism and the transition gear refers to as a second pivoting point, and a distance between the second center point and the second pivoting point refers to as $l_3$. According to the present invention, $l_3$ is greater than 0. In such way, a lever arm can be formed between the second center point and the second pivoting point, which will facilitate driving the transition gear by the linkage mechanism.

The radius of the transition gear refers to as R. According to the present invention, the distance $l_3$ between the second center point and the second pivoting point is greater than or equal to $$\frac{1}{2}R.$$

With such configuration, the transition gear can be driven to rotate without overlarge driving force, and the overall size of the aperture assembly can be reduced as much as possible.

According to the present invention, the transition gear has a first extreme rotational position and a second extreme rotational position, when the transition gear moves to the first extreme rotational position, the optical shutter will move to a fully open state thereof, and when the transition gear is in the second extreme rotational position, the optical shutter will move to a fully closed state thereof. The optical shutter includes a plurality of light shades which can be overlapped or unfolded with each other with rotation of the driving ring, thus switching the open state to the closed state of the optical shutter. In such way, the transition gear is limited to move back and forth between the first extreme rotational position and the second extreme rotational position, which can avoid the situation that when the optical shutter has already been in the fully open state or the fully closed state, the transition gear still continues to drive the driving ring to rotate, and consequently the light shades of the optical shutter still continue to move and press against each other, eventually causing damage to the optical shutter.

According to the present invention, the transmission ratio of the transition gear to the driving ring is less than or equal to 2:1. Such configuration can avoid requirement of larger driving force due to too small size of the transition gear, thereby improving the driving efficiency of the transition gear.

In order to drive the driving ring with a small driving force and keep the size of the aperture assembly to avoid increase of overall size of the aperture assembly due to the overlarge transition gear, the transmission ratio of the transition gear to the driving ring is preferably greater than 4:3.

According to some embodiments, the transition gear is indirectly meshed with the sawtooth segment. In this case, a transmission gear arranged between the transition gear and the sawtooth segment is provided, which is simultaneously meshed with the transition gear and the sawtooth segment. In such configuration, the motor can drive the transition gear to rotate through the linkage mechanism, and the transition gear can further transmit the driving force to the optical shutter through the transmission gear.

Alternatively, in the case that the transition gear is indirectly meshed with the sawtooth segment, a synchronous belt connecting the sawtooth segment and the transition gear simultaneously is provided, the transition gear thus can drive the driving ring to rotate via the synchronous belt. On one hand, as the synchronous belt are generally elastic, compared with rigid meshing connection between gears, in combination of synchronous belt and sawtooth can avoid possible abrasion. On the other hand, the synchronous belt is convenient to maintain and has low operating cost.

According to the present invention, a first positioning member and a second positioning member for determining an initial mounting angle of the driving ring are further provided. The first positioning member is arranged on the base plate, and the second positioning member is arranged on the driving ring. The first positioning member and the second positioning member cooperate to position the optical shutter at a fully open state or a fully closed state. The configuration of the first positioning member and the second positioning member thus can facilitate the assembly of the optical shutter, which ensures that the optical shutter is at the fully open state or the fully closed state after the assembly thereof is completed, thereby further facilitating the control of the state of the optical shutter.

Similarly, a first positioning member and a second positioning member for determining an initial mounting angle of the transition gear can also be provided according to the present invention. The first positioning member is arranged on the base plate, and the second positioning member is arranged on the transition gear. The first positioning member and the second positioning member cooperate to mesh the transition gear in the initial mounting angle with the sawtooth segment of the optical shutter at the fully open state or the fully closed state, Therefore, the transition gear can be conveniently and rapidly mounted.

Specifically, the first positioning member can be a limiting post, and the second positioning member can be an arc-shaped groove; or the first positioning member can be an arc-shaped groove, and the second positioning member can be a limiting post. Accurate positioning thus can be achieved without changing the overall space occupied by the aperture assembly, with cooperation of the limiting post and the arc-shaped groove.

According to the present invention, a sawtooth edge of the transition gear for the sawtooth thereof can be made of rubber material. Compared to rigid meshing of the sawtooth edge of the transition gear with the sawtooth segment of the driving ring, the sawtooth edge made of rubber material can avoid possible abrasion caused by long-term rigid meshing of the sawtooth, ensuring transmission accuracy between the transition gear and the optical shutter.

In another aspect of the present invention, a stage light fixture is further provided, which includes the aperture assembly described above, a light source assembly generating a light beam, and a lens assembly. The light beam has a main optical axis. The aperture assembly and the lens assembly are arranged in sequence along the emitting direction of the light beam. The aperture assembly is especially arranged close to a focal point of the light beam, and a central axis of the aperture assembly coincides with the main optical axis.

DETAILED DESCRIPTION

Figure 1:
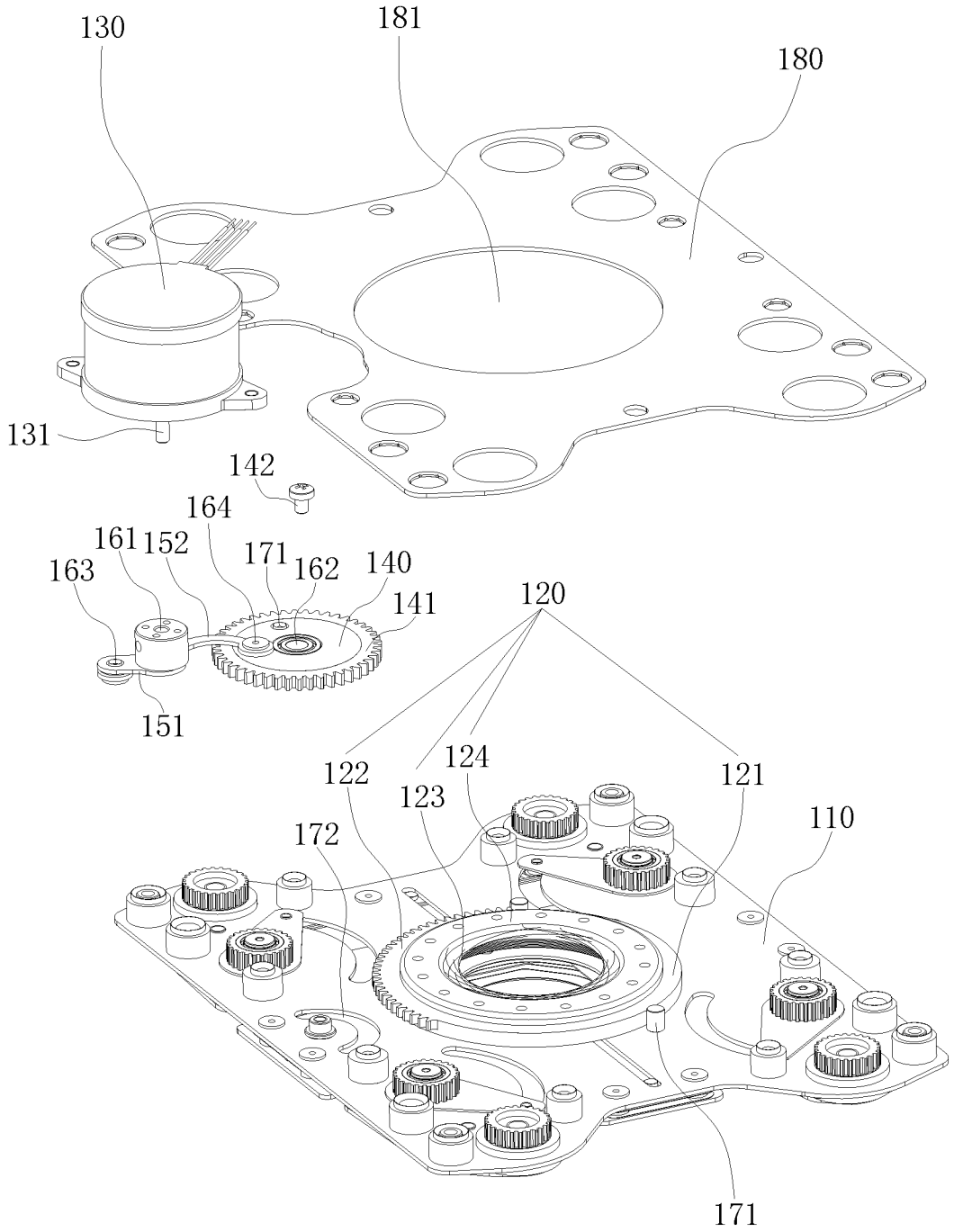
FIG. 1 is a schematic diagram of an exploded structure of a small-sized aperture assembly according to one embodiment of the present invention.

The accompanying drawings are for exemplary illustration only, and should not be construed as limitations on this patent; in order to better illustrate this embodiment, some parts in the accompanying drawings may be omitted, enlarged or reduced, and they do not represent the size of the actual product; for those skilled in the art, it is understandable that certain well-known structures and descriptions thereof in the drawings may be omitted. The positional relationship described in the drawings is only for exemplary illustration, and should not be construed as limitations on this patent.

According to at least one embodiment, as shown in FIG. 1 to FIG. 4, a small-sized aperture assembly includes a base plate 110, an optical shutter 120 fixed to the base plate 110, a motor 130 providing a driving force, a linkage mechanism 150 with one end connected to the motor 130, and a transition gear 140 arranged between the linkage mechanism 150 and the optical shutter 120. A periphery of the optical shutter 120 is provided with a sawtooth segment 122 which is directly or indirectly meshed with the transition gear 140. The other end of the linkage mechanism 150 is hinged to the transition gear 140, so that the transition gear 140 can be driven to move by the linkage mechanism 150 under the driving of the motor 130, thereby enabling the optical shutter 120 to switch between a closed state and an open state.

According to the present embodiment, a transition gear 140 is provided between the linkage mechanism 150 and the optical shutter 120, so that the linkage mechanism 150 can transmit the driving force of the motor 130 to the transition gear 140, the transition gear thus can rotate to drive the optical shutter 120, especially a driving ring 121 thereof, to rotate to switch the state of the optical shutter 120. Therefore, with such transmission configuration, the transition gear 140 can be driven to rotate by the linkage mechanism 150 with shot length, which greatly reduces the size of the aperture assembly 100. In addition, as the linkage mechanism 150 is not directly connected to the optical shutter 120, it is not required to design an arc-shaped segment with a large radian to avoid the situation that the linkage mechanism 150 overlaps with the optical shutter 120 to affect the light effect, which effectively reduces the space occupied by the linkage mechanism 150, thereby further reducing the size of the aperture assembly 100.

Referring to FIG. 1, the base plate 110 has a light passing hole for a light beam to pass through, and the optical shutter 120 is correspondingly arranged relative to the light passing hole. The optical shutter 120 can include a fixing ring 124 fixedly connected to the base plate 110, a driving ring 121 with the sawtooth segment 122 provided on the periphery thereof, and a bearing supported between the fixing ring 124 and the driving ring 121 in a sleeved mode. According to one embodiment, the optical shutter 120 and the transition gear 140 are mounted on the base plate 110, while the linkage mechanism 150 can be mounted independent from the base plate 110.

According to some embodiments of the present invention, projection of rotation centers of the transition gear 140, the optical shutter 120, and the motor 130 is preferably collinear, which can achieve more reasonable arrangement. An anti-reflection film can be sprayed or pasted on both the transition gear 140 and the linkage mechanism 150 to prevent light reflection.

According to some embodiments of the present invention, the sawtooth segment 122 on the periphery of the optical shutter 120 is preferably directly meshed with the transition gear 140.

A cover plate 180 covering the base plate 110 can be provided. The cover plate 180 is correspondingly provided with a through hole 181 relative to the optical shutter 120, and the cover plate 180 is provided with an avoiding space corresponding to the movement range of the linkage mechanism 150. With the configuration of the cover plate 180, on one hand, the aperture assembly 100 can be integrally formed with aesthetic feeling, on the other hand, a space accommodating other transmission components, such as the optical shutter 120 and the transition gear 140, can be formed between the cover plate 180 and the base plate 110 to protect the components from damage.

Figure 3:
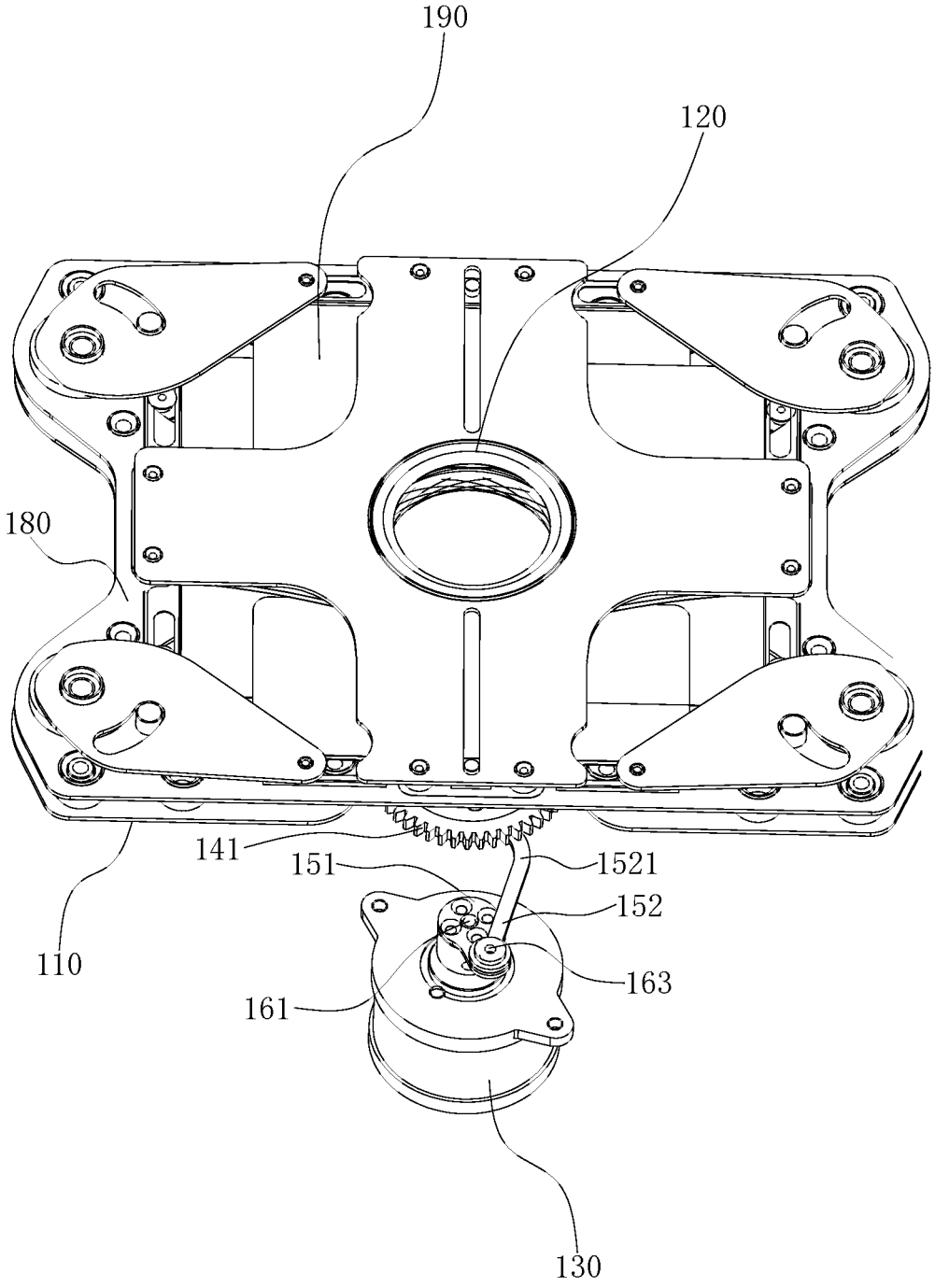
FIG. 3 is another perspective view of the small-sized aperture assembly according to one embodiment of the present invention.
Figure 4:
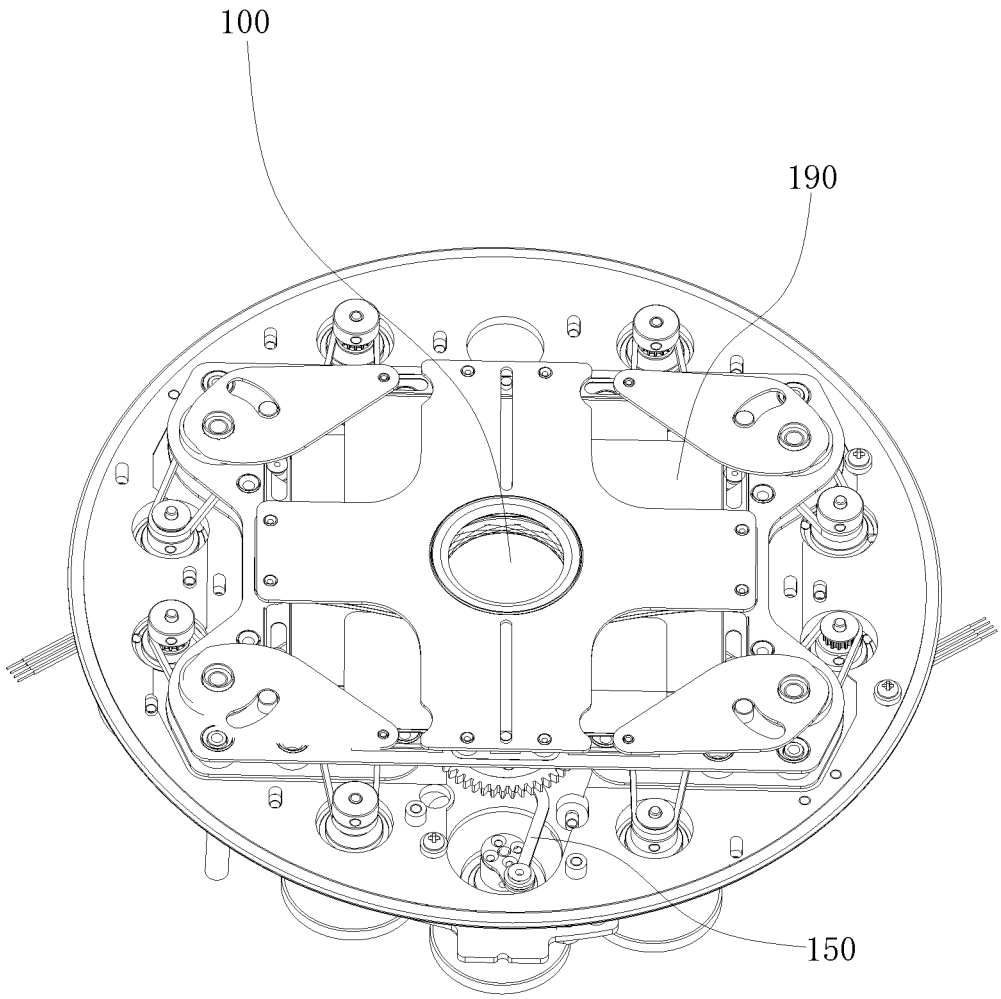
FIG. 4 is a perspective view of the small-sized aperture assembly according to one embodiment of the present invention, which is assembled with a light shade.

Specifically, according to some embodiments of the present invention, referring to FIG. 1 and FIG. 3, the linkage mechanism 150 includes a shaft arm 151 and a swing rod 152 pivotally connected to each other. The other end of the shaft arm 151 is fixedly connected to the motor 130, and the other end of the swing rod 152 is pivotally connected to the transition gear 140. For clarity, a rotation center of the shaft arm 151 refers to as a first center point 161, a rotation center of the transition gear 140 refers to as a second center point 162, a pivoting position of the shaft arm 151 and the swing rod 152 refers to as a first pivoting point 163, and a pivoting position of the swing rod 152 and the transition gear 140 is a second pivoting point 164. A distance between the first center point 161 and the first pivoting point 163 refers to as $l_1$, a distance between the first pivoting point 163 and the second pivoting point 164 refers to as $l_2$, a distance between the second pivoting point 164 and the second center point 162 refers to as $l_3$, and a distance between the first center point 161 and the second center point 162 refers to as $l_4$. In the present embodiment, $l_1$, $l_2$, $l_3$ and $l_4$ simultaneously conform to the following relationship: $l_1+l_2 \leq l_3+l_4$, and $l_2+l_3 \geq l_1+l_4$, $l_1$, $l_2$, $l_3$ and $l_4$ are all greater than 0. With such configuration, it is effectively ensured that under driving by the motor 130, the shaft arm 151 can rotate by circles around the first center point 161 without being restricted. Within the relationship $l_1+l_2 \leq l_3+l_4$, it is ensured that the swing rod 152 can be driven by the shaft arm 151 to move back and forth.

In a transmission way in which a driving gear is directly meshed with the driving ring 121 of the optical shutter 120 without a linkage mechanism, the open and closed states of the optical shutter 120 are switched with back-and-forth rotation of the driving gear. That is, in such transmission way, the motor connected to the driving gear is required to repeatedly perform operations of "forward starting-forward rotating-braking-reverse starting-reverse rotating-braking". As well known, repeated starting and braking of the motor seriously affects efficiency of the optical shutter 120 for switching the state, making it difficult for the optical shutter 120 to rapidly and repeatedly switch the open and closed states. However, according to the present embodiment, in combination with the linkage mechanism 150 and the transition gear 140, the size of the aperture assembly 100 can be effectively reduced as described above, and the motor 130 can continuously rotate in the same direction to drive the linkage mechanism 150 to drive the transition gear 140 to move back and forth, that is, the motor 130 in the present embodiment can avoid repeating operations of braking and starting, the optical shutter 120 thus can rapidly switch the open and closed states, thereby achieving effect of rapid light shading.

Preferably, when $l_1$, $l_2$, $l_3$ and $l_4$ meet the relationship $l_1+l_2=l_3+l_4$, a reset element is further provided. In such way, when the swing rod 152 and the second pivoting point 164 are collinear, the reset element applies a tensile force to the swing rod 152, which changes the movement direction of the swing rod 152, and enables the swing rod to move back, so that the swing rod 152 can be swung within 180 degrees, and the swing rod 152 can be prevented from jamming during the reciprocating swing. The reset member may be a tension spring.

Figure 2:
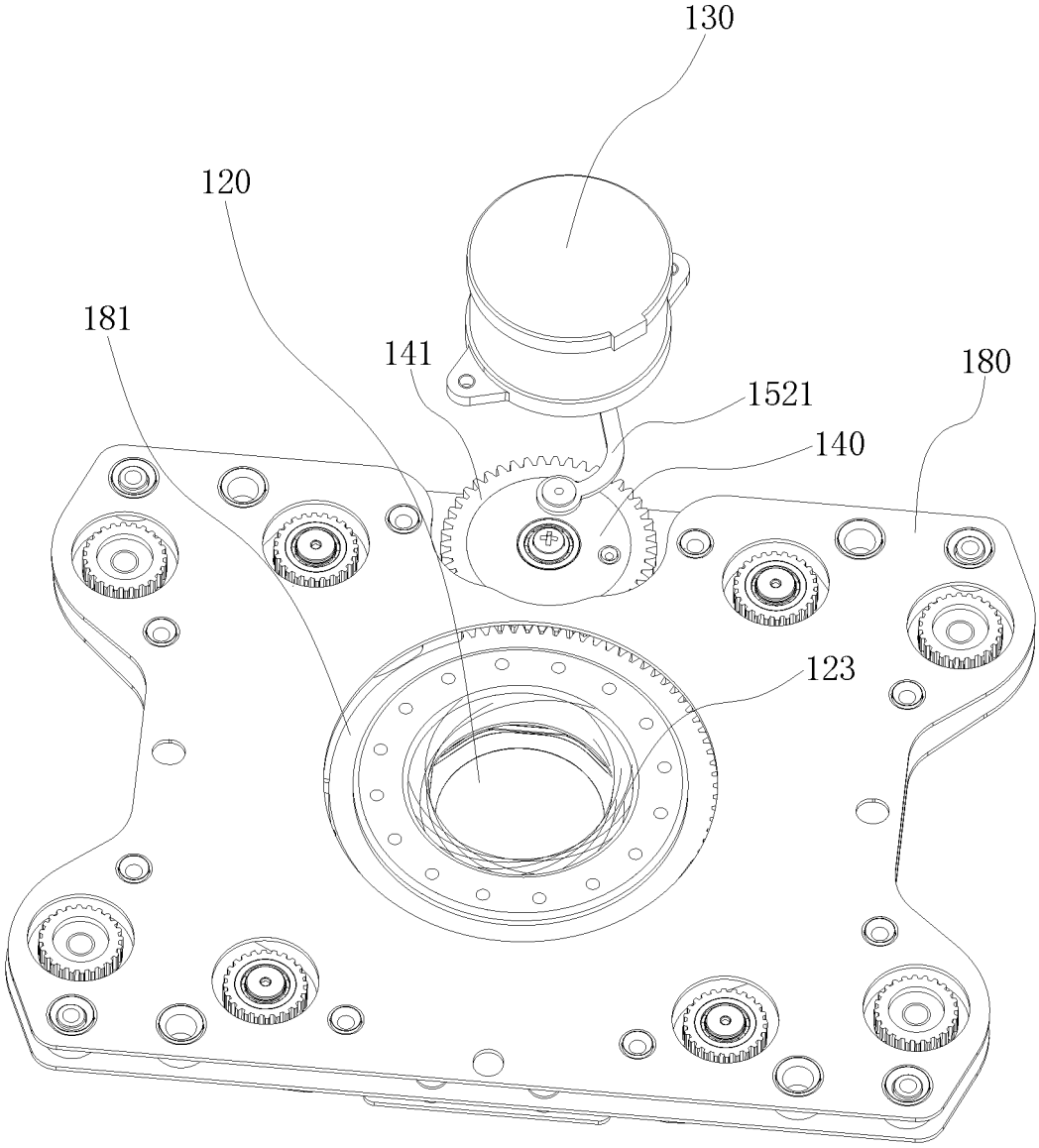
FIG. 2 is a perspective view of the small-sized aperture assembly according to one embodiment of the present invention.

According to some embodiments of the present invention, the linkage mechanism 150 includes a shaft arm 151 and a swing rod 152 pivotally connected to each other. The other end of the shaft arm 151 is fixedly connected to the motor 130, and the other end of the swing rod 152 is pivotally connected to the transition gear 140. Referring to FIG. 2 and FIG. 3, the swing rod 152 is provided with an arc-shaped avoiding segment 1521 at the pivoting position with the transition gear 140. With configuration of the arc-shaped avoiding segment 1521, interference of the swing rod 152 with a pivoting member 142 for fixing the transition gear 140 during movement of the swing rod 152 can be avoided. Especially, the pivoting member 142 can be a screw. The transition gear 140 is pivotally connected to the base plate 110 via the screw.

A rotation center of the transition gear 140 refers to as a second center point 162, a pivoting position of the linkage mechanism 150 and the transition gear 140 refers to as a second pivoting point 164, and a distance between the second center point 162 and the second pivoting point 164 is $l_3$. According to some embodiments, $l_3$ is greater than 0. In such way, a lever arm is formed between the second center point 162 and the second pivoting point 164, which facilitates driving the transition gear 140 by the linkage mechanism 150. That is, the second pivoting point 164 may be located at a position on the surface of the transition gear 140 which does not coincide with the second center point 162, or may be located at the edge of the transition gear 140.

The radius of the transition gear 140 refers to as R. According to the embodiment, the distance $l_3$ between the second center point 162 and the second pivoting point 164 is greater than or equal to $$\frac{1}{2}R.$$

With such configuration, the transition gear 140 can be driven to rotate without overlarge driving force, and the overall size of the aperture assembly 100 can also be reduced as much as possible.

Preferably, $l_3$ is $$\frac{1}{2}$$

of the radius R of the transition gear 140.

According to some embodiments of the preset invention, the transition gear 140 has a first extreme rotational position and a second extreme rotational position. When the transition gear 140 moves to the first extreme rotational position, the optical shutter 120 will move to a fully open state, and when the transition gear 140 is in the second extreme rotational position, the optical shutter 120 will move to a fully closed state. The optical shutter 120 includes a plurality of light shades 123 which can be overlapped or unfolded with each other by rotating the driving ring 121, thus realizing the open or closed state of the optical shutter 120. In such way, the transition gear 140 is limited to move back and forth between the first extreme rotational position and the second extreme rotational position, which avoids the situation that when the optical shutter 120 has already been at the fully open state or the fully closed state, the transition gear 140 still continues to drive the driving ring 121 to rotate, and consequently the light shades 123 of the optical shutter 120 still continue to move and press against each other, eventually causing damage to the optical shutter 120.

It is to be noted that, when the optical shutter 120 is at the fully opened state, edges of the plurality of light shades 123 together form an approximately circular light passing hole, and the size of the hole reaches the maximum size. Conversely, when the optical shutter 120 is in the fully closed state, the overlapping range between the plurality of the light shade 123 is minimized, but there may still be a light passing hole with a small size at the edges of the light shades 123.

According to a preferable embodiment of the present invention, the transmission ratio of the transition gear 140 to the driving ring 121 is less than or equal to 2:1. Such configuration can avoid requirement of larger driving force due to too small size of the transition gear 140, thus improving the driving efficiency of the transition gear 140.

In order to drive the driving ring 121 with a small driving force and keep the size of the aperture assembly 100 to avoid increase of overall size of the aperture assembly 100 due to the overlarge transition gear 140, the transmission ratio of the transition gear 140 to the driving ring 121 is preferably greater than 4:3. However, the transmission ratio of the transition gear 140 to the driving ring 121 is preferably 2:1.

According to some embodiments of the present invention, the transition gear 140 is indirectly meshed with the sawtooth segment 122. In this case, a transmission gear arranged between the transition gear 140 and the sawtooth segment 122 is provided, which is simultaneously meshed with the transition gear 140 and the sawtooth segment 122, so that the motor 130 can drive the transition gear 140 to rotate through the linkage mechanism 150, and the transition gear 140 can further transmit the driving force to the optical shutter 120 through the transmission gear.

Alternatively, in the case that the transition gear 140 is indirectly meshed with the sawtooth segment 122, a synchronous belt connecting with the sawtooth segment 122 and the transition gear 140 simultaneously is provided, the transition gear 140 thus can drive the driving ring 121 to rotate via the synchronous belt. As the synchronous belt are generally elastic, compared with rigid meshing connection between gears, in combination of synchronous belt and sawtooth can avoid possible abrasion. On the other hand, the synchronous belt is convenient to maintain and has low operating cost. It is to be noted that, other transmission ways may be used to indirectly mesh the sawtooth segment 122 of the drive ring 121 with the transition gear 140.

In order to determine an initial mounting angle of the driving ring 121, a first positioning member and a second positioning member are provided according to some embodiments. The first positioning member can be arranged on the base plate 110, and the second positioning member can be arranged on the driving ring 121. The first positioning member and the second positioning member cooperate to position the optical shutter 120 at the fully open state or the fully closed state. The configuration of the first positioning member and the second positioning member can facilitate the assembly of the optical shutter 120, so that the optical shutter is at the fully open state or the fully closed state after the assembly thereof is completed, which thus facilitates the control of the state of the optical shutter 120.

Similarly, in order to determine an initial mounting angle of the transition gear 140, a first positioning member and a second positioning member can also be provided according to some embodiments of the present invention. The first positioning member can be arranged on the base plate 110, and the second positioning member can be arranged on the transition gear 140. The first positioning member and the second positioning member cooperate to mesh the transition gear 140 in the initial mounting angle with the sawtooth segment 122 of the optical shutter 120 at a fully open state or a fully closed state. Therefore, the transition gear 140 can be conveniently and rapidly mounted.

According to some embodiments, the first positioning member may be a limiting post, and the second positioning member may be an arc-shaped groove; or the first positioning member may be an arc-shaped groove, and the second positioning member may be a limiting post. Accurate positioning thus can be achieved without changing the overall space occupied by the aperture assembly 100, with cooperation of the limiting post and the arc-shaped groove.

Referring to FIG. 1, in the present embodiment, the first positioning member of the transition gear 140 is an arc-shaped groove 172 arranged in the base plate 110, and the second positioning member of the transition gear 140 is a limiting post 171 arranged on a side of the transition gear 140 close to the base plate 110.

The first positioning member of the driving ring 121 includes two limiting posts 171 arranged on the base plate 110. The sawtooth segment 122 can be prevented from non-meshing with the transition gear 140 in a way that sawtooth of the sawtooth segment 122 at the two ends thereof are abutted against each limiting post 171. The second positioning member of the driving ring 121 in this case can be the sawtooth or arc-shaped groove at each end of the sawtooth segment 122.

According to some embodiments, a sawtooth edge 141 of the transition gear 140 for the sawtooth thereof can be made of rubber material. Compared to rigid meshing of the sawtooth edge 141 of the transition gear 140 with the sawtooth segment 122 of the driving ring 121, the sawtooth edge 141 made of rubber material can avoid possible abrasion caused by long-term rigid meshing of the sawtooth, ensuring transmission accuracy between the transition gear 140 and the driving ring 121.

According to some embodiments, the transition gear 140 includes a rotating disc and the sawtooth edge 141 sleeved on the periphery of the rotating disc. The rotating disc may be made of metal material, ensuring more reliable connection between the transition gear 140 and the base plate 110 or the linkage mechanism 150.

Optionally, the transition gear 140 may also be an integrally formed rubber gear.

Figure 5:
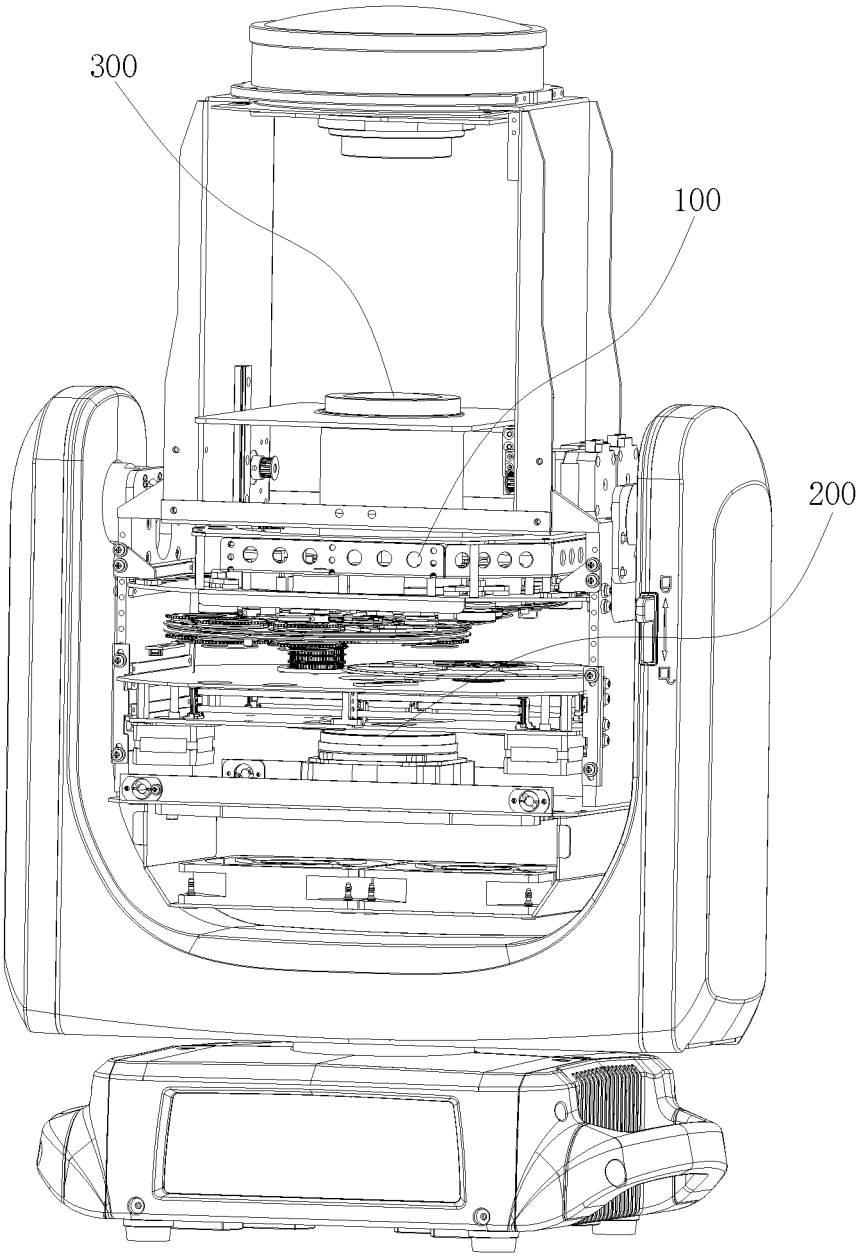
FIG. 5 is a structural schematic diagram of a stage light fixture with a aperture assembly according to one embodiment of the present invention.

A stage light fixture is further provided. As shown in FIG. 5, the stage light fixture includes the aperture assembly 100 described above according to any embodiment, a light source assembly 200 generating a light beam, and a lens assembly. The light beam has a main optical axis. The aperture assembly 100 and the lens assembly are arranged in sequence in the emitting direction of the light beam. The aperture assembly 100 is especially arranged close to a focal point of the light beam, and a central axis of the aperture assembly 100 coincides with the main optical axis.

The light fixture can also include a plurality of light blades 190 mounted on the base plate 110 and another driving motor driving the light blades 190 to move. Therefore, light spots with various shapes can be projected by shielding the light beam in combination with the cutting blades 190 and the optical shutter 120.

Obviously, the above-mentioned embodiments of the present invention are only examples for clearly illustrating the present invention, rather than limiting the implementation modes of the present invention. For those of ordinary skill in the art, changes or modifications in other different forms can also be made on the basis of the above description. It is not needed and it is impossible to list all implementation modes here. Any modifications, equivalent replacements and improvements made within the spirit and principles of the present invention shall be included within the protection scope of the claims of the present invention.

The invention claimed is:

1. A small-sized aperture assembly, comprising a base plate;

an optical shutter fixed to the base plate, which has a driving ring;

a motor providing a driving force;

a transition gear arranged between the motor and the optical shutter, a periphery of the driving ring being provided with a sawtooth segment which is meshed with the transition gear, and a linkage mechanism comprising a shaft arm and a swing rod pivotally connected to each other at an end of each, the other end of the shaft arm is fixedly connected to the motor, and the other end of the swing rod is pivotally connected to the transition gear, wherein the linkage mechanism is configured to drive the transition gear to rotate the driving ring to switch the optical shutter between a closed state and an open state.

2. The aperture assembly according to claim 1, wherein a rotation center of the shaft arm refers to as a first center point, a rotation center of the transition gear refers to as a second center point, a pivoting position of the shaft arm and the swing rod refers to as a first pivoting point, and a pivoting position of the swing rod and the transition gear refers to as a second pivoting point;

a distance between the first center point and the first pivoting point refers to as $l_1$, a distance between the first pivoting point and the second pivoting point refers to as $l_2$, a distance between the second pivoting point and the second center point refers to as $l_3$, and a distance between the first center point and the second center point refers to as $l_4$, and wherein $l_1$, $l_2$, $l_3$ and $l_4$ simultaneously conform to the following relationship: $l_1+l_2 \leq l_3+l_4$, $l_2+l_3 \geq l_1+l_4$, and $l_1$, $l_2$, $l_3$ and $l_4$ are all greater than 0.

3. The aperture assembly according to claim 1, wherein the swing rod is provided with an arc-shaped avoiding segment at the pivoting position with the transition gear.

4. The aperture assembly according to claim 1, wherein a rotation center of the transition gear refers to as a second center point, a pivoting position of the linkage mechanism and the transition gear refers to as a second pivoting point, and a distance between the second center point and the second pivoting point refers to as $l_3$, $l_3$ is greater than 0.

5. The aperture assembly according to claim 4, wherein the radius of the transition gear refers to as R, the distance $l_3$ between the second center point and the second pivoting point is greater than or equal to $$\frac{1}{2}R.$$

6. The aperture assembly according to claim 1, wherein the transition gear has a first extreme rotational position and a second extreme rotational position, when the transition gear moves to the first extreme rotational position, the optical shutter moves to a fully open state thereof, and when the transition gear is in the second extreme rotational position, the optical shutter moves to a fully closed state thereof.

7. The aperture assembly according to claim 6, wherein the transmission ratio of the transition gear to the driving ring is less than or equal to 2:1.

8. The aperture assembly according to claim 7, wherein the transmission ratio of the transition gear to the driving ring is greater than 4:3.

9. The aperture assembly according to claim 1, where in the transition gear is indirectly meshed with the sawtooth segment, a transmission gear arranged between the transition gear and the sawtooth segment is provided, which is simultaneously meshed with the transition gear and the sawtooth segment.

10. The aperture assembly according to claim 1, wherein the transition gear is indirectly meshed with the sawtooth segment, a synchronous belt connected with the sawtooth segment and the transition gear simultaneously is provided, the transition gear is configured to drive the driving ring to rotate via the synchronous belt.

11. The aperture assembly according to claim 1, further comprising a first positioning member and a second positioning member for determining an initial mounting angle of the driving ring, the first positioning member being arranged on the base plate, the second positioning member being arranged on the driving ring, wherein the first positioning member and the second positioning member is configured to cooperate to position the optical shutter at a fully open state or a fully closed state.

12. The aperture assembly according to claim 11, wherein the first positioning member is a limiting post, and the second positioning member is an arc-shaped groove; or the first positioning member is an arc-shaped groove, and the second positioning member is a limiting post.

13. The aperture assembly according to claim 1, further comprising a first positioning member and a second positioning member for determining an initial mounting angle of the transition gear, the first positioning member being arranged on the base plate, the second positioning member being arranged on the transition gear, wherein the first positioning member and the second positioning member is configured to cooperate to mesh the transition gear in the initial mounting angle with the sawtooth segment of the optical shutter at a fully open state or a fully closed state.

14. The aperture assembly according to claim 13, wherein the first positioning member is a limiting post, and the second positioning member is an arc-shaped groove; or the first positioning member is an arc-shaped groove, and the second positioning member is a limiting post.

15. The aperture assembly according to claim 1, wherein a sawtooth edge of the transition gear is made of rubber material.

16. A stage light fixture, comprising the aperture assembly according to claim 1;

a light source assembly for generating a light beam with a main optical axis; and a lens assembly, wherein the aperture assembly and the lens assembly are arranged in sequence in the emitting direction of the light beam, the aperture assembly is arranged close to a focal point of the light beam, and a central axis of the aperture assembly coincides with the main optical axis.

* * * * *